US005131118A

United States Patent [19]

Breeher

[11] Patent Number: 5,131,118

[45] Date of Patent: Jul. 21, 1992

[54] RELEASABLY SECURING CONNECTOR

[76] Inventor: Gregory P. Breeher, 3916 Webber Rd., St. Louis, Mo. 63123

[21] Appl. No.: 651,764

[22] Filed: Feb. 7, 1991

[51] Int. Cl.[5] ..... A44B 21/00

[52] U.S. Cl. ..... 24/306

[58] Field of Search ..... 24/16 R, 16 PB, 306, 24/442; 128/DIG. 15; 2/DIG. 6; 248/205.2, 104; 211/118

[56] References Cited

U.S. PATENT DOCUMENTS

| | | | |
|---|---|---|---|
| 3,122,120 | 2/1964 | Jorgenson . | |
| 3,126,860 | 3/1964 | Shepperton . | |
| 3,183,877 | 5/1965 | Benzel . | |
| 3,842,779 | 10/1974 | Jaynes . | |
| 3,866,276 | 2/1975 | Perkins | 24/306 X |
| 3,960,302 | 6/1976 | Mazzoni, Jr. | 24/306 X |
| 4,462,329 | 7/1984 | Brushaber . | |
| 4,672,910 | 6/1987 | Cook . | |
| 4,917,039 | 4/1990 | Sierq . | |
| 4,937,920 | 7/1990 | Tsai | 24/442 X |

*Primary Examiner*—James R. Brittain

*Attorney, Agent, or Firm*—Senniger, Powers, Leavitt & Roedel

[57] ABSTRACT

A connector for releasably securing a first article, such as a part of a boat, to a second article, such as a boat bumper. The connector comprises a generally flat elongate flexible strap having first and second faces, first and second end regions, and an intermediate region between the end regions. The connector further comprises securing members adjacent the first end region for connecting the strap to the first article. The securing members include first and second releasably mateable fastening panels fixed to the first face of the strap for forming a first loop around the first article. The first fastening panel is fixed to the first face of the strap adjacent the first end region and the second fastening panel is fixed to the first face of the strap at the intermediate region. The first fastening panel is selectively mateable with any one of several portions of the second fastening panel along a predetermined range of the intermediate region so that the size of the loop can be varied. The securing members further includes a member for securely locking the first fastening panel to any selected portion of the second fastening panel. The connector further comprises a mechanism adjacent the second end region for connecting the strap to the second article.

15 Claims, 3 Drawing Sheets

RELEASABLY SECURING CONNECTOR

BACKGROUND OF THE INVENTION

This invention relates generally to connectors, and more particularly to a connector for releasably securing a first article, such as a part of a boat, to a second article, such as a boat bumper.

It is often desirable to tether a boat bumper or some other article to a boat railing or other portion of the boat. Also, it is often desirable to tether a boat to a dock cleat. Rope is commonly used for connecting boat bumpers to boats and for tying boats to dock cleats. However, a disadvantage of using rope for these purposes is that tying a proper knot is often difficult and time consuming, especially for a novice boater. Another disadvantage of using a rope is that to change the effective length of the rope, i.e., the distance the rope holds one article to another article, the rope must be untied from at least one of the articles and then retied, which may be cumbersome and time consuming.

SUMMARY OF THE INVENTION

Among the objects of the present invention may be noted the provision of an improved connector for releasably securing a first article to a second article; the provision of such a connector in which the effective length of the connector is quickly and easily adjustable; and the provision of such a connector which is easy to use.

Generally a connector of the present invention is adapted for releasably securing a first article, such as a part of a boat, to a second article, such as boat bumper. The connector comprises a generally flat elongate flexible strap having first and second faces, first and second end regions, and an intermediate region between the end regions. The connector further comprises means adjacent the first end region for connecting the strap to the first article and means adjacent the second end region for connecting the strap to the second article. The means for connecting the strap to the first article comprises first and second releasably mateable fastening means fixed to the first face of the strap for forming a first loop around the first article. The first fastening means is fixed to the first face of the strap adjacent the first end region. The second fastening means is fixed to the first face of the strap at the intermediate region. The first fastening means is selectively mateable with any one of several portions of the second fastening means along a predetermined range of the intermediate region so that the size of the loop can be varied. The means for connecting the strap to the first article further comprises means for securely locking the first fastening means to any selected portion of the second fastening means.

These and other advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
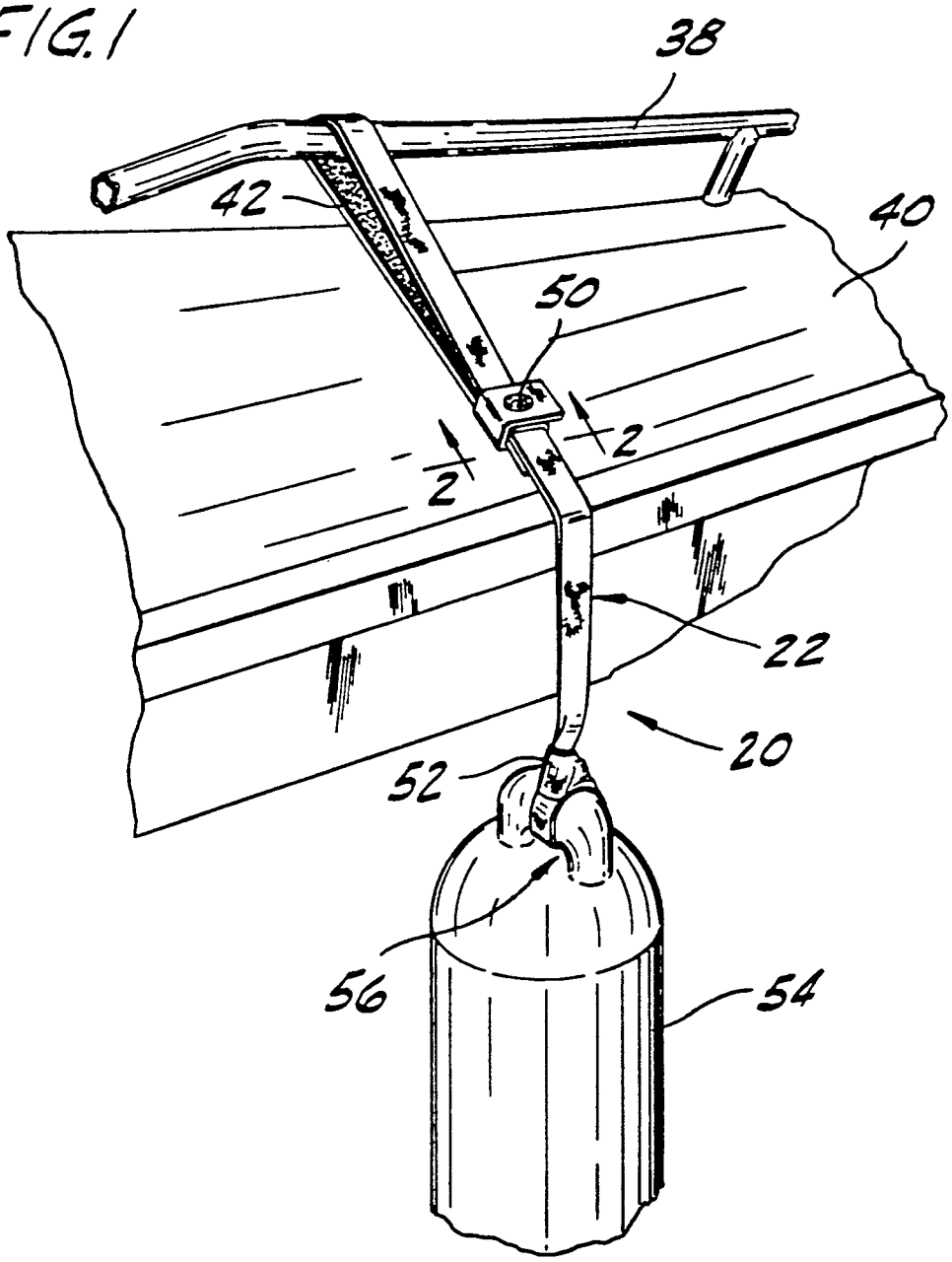
FIG. 1 is a perspective view of the connector of this invention securing a boat bumper to the railing of a boat.
Figure 2:
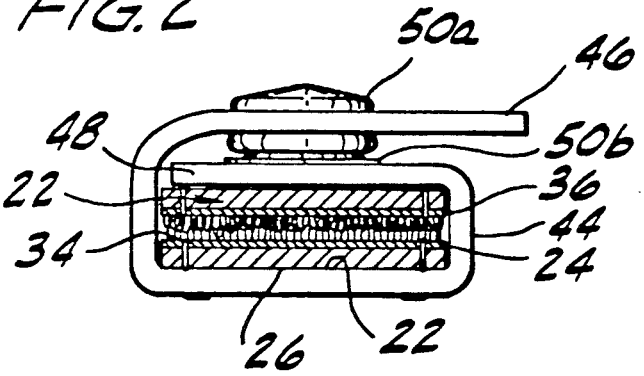
FIG. 2 is a sectional view taken along the plane of line 2—2 of FIG. 1.
Figure 3:
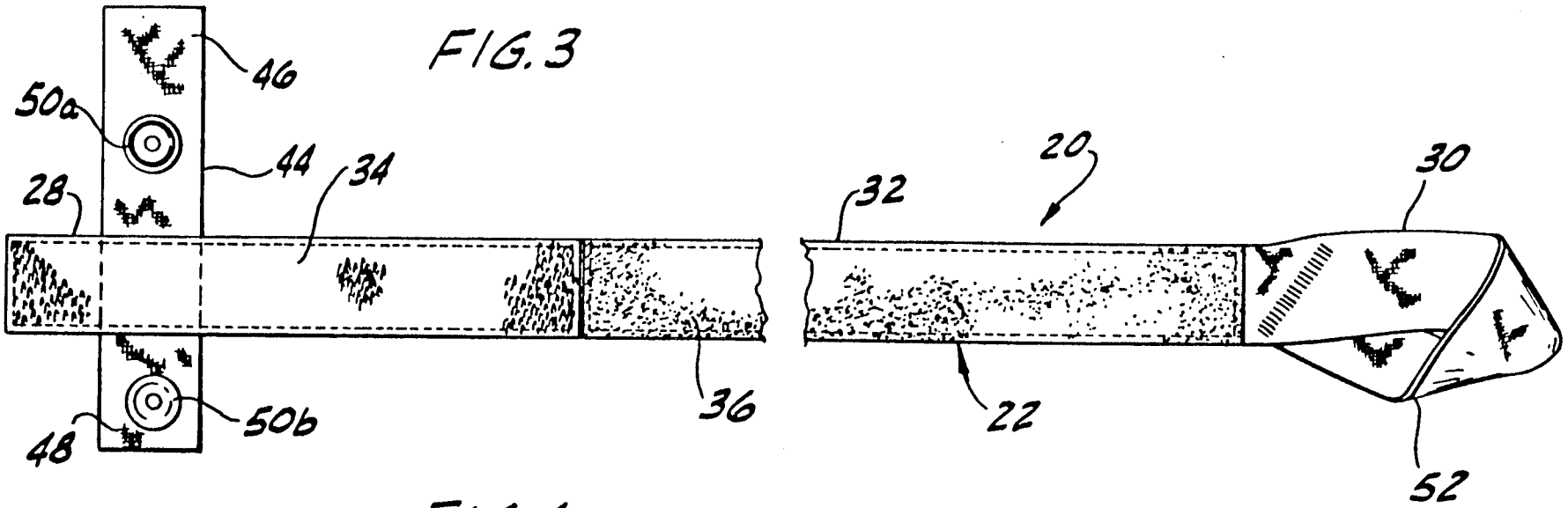
FIG. 3 is a top plan view of the connector of this invention.
Figure 4:
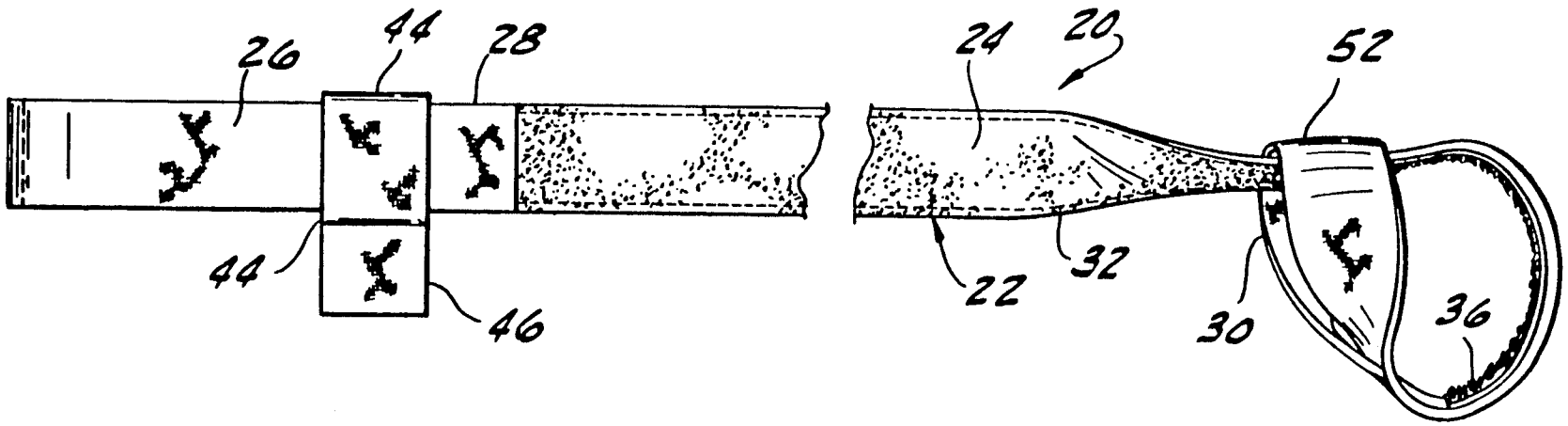
FIG. 4 is a top plan view of the connector of FIG. 3 with the panel of loop-type fastening material mated with the panel of hook-type fastening material to form the first loop.

A connector constructed according to the principles of this invention is indicated generally as 20 in FIGS. 1–4. The connector 20 is adapted for releasably securing a first article to a second article. It comprises a generally flat elongate flexible strap 22, preferably formed of a nylon webbing, having first and second faces 24 and 26, first and second end regions 28 and 30, and an intermediate region 32 between the end regions.

A panel of loop-type fastening material 34 is secured, for example, by stitching or gluing, to the first face 24 of the strap 22 and adjacent the first end region 28 of the strap 22. A panel of hook-type fastening material 36 is secured, for example, by stitching or gluing, to the first face 24 of the strap 22 and adjacent the intermediate region 32 of the strap 22. The loop-type panel 34 and the hook-type panel 36 are of the type commonly sold under the trademark, Velcro, and are adapted for being mated together. In FIG. 1, the strap 22 is threaded through a railing 38 of a boat 40 and the first end region 28 is folded onto the intermediate region 32 to mate at least a portion of the loop-type panel 34 with a portion of the hook-type panel 36 and form a first loop 42. The panels 34 and 36 constitute mateable fastening means for forming a first loop around a first article. The loop-type panel 34 is selectively mateable with any one of several portions of the hook-type panel 36 along a predetermined range of the intermediate region 32 so that the size of the first loop 42 can be varied. If it is desirable to make a smaller first loop, the loop-type panel 34 is mated with a portion of the hook-type panel 36 closer to the first end region 28. If it is desirable to make a larger first loop, the loop-type panel 34 is mated with a portion of the hook-type panel 36 farther from the first end region 28. Although, the connector 20 has been described as having the loop-type panel 34 adjacent the first end region 28 and the hook-type panel 36 adjacent to the intermediate region 32, it is to be understood that the orientation of the two panels 34 and 36 could be reversed without departing from the scope of this invention.

A strip 44 is fixed, preferably by stitching, transversely to the strap 22 adjacent the first end region 28 of the strap 22. The strip 44 has first and second end regions 46 and 48. A female portion **50*a* of a snap fastener 50 is secured to the first end region 46 of the strip 44 and a male portion 50*b* of the snap fastener 50 is secured to the second end region 48 of the strip 44. The snap fastener 50 constitutes means for securing the first end region 46 of the strip 44 to the second end region 48 of the strip 44. When the loop-type panel 34 is mated with a portion of the hook-type panel 36, the strip 44 is wrapped around the intermediate region 32 of the strap 22 adjacent the selected portion of the hook-type panel 36 and the female portion 50*a* of the snap fastener 50 is snapped onto the male portion 50*b* to maintain the loop-type panel 34 in contact with the hook-type panel 36**.

Thus, the strip 44 and snap fastener 50 constitute means for securely locking the loop-type panel 34 to any selected portion of the hook-type panel 36. Also, the strip 44, snap fastener 50, and panels 34 and 36 constitute means adjacent the first end region for connecting the strap 22 to a first article.

The second end region 30 of the strap 22 is doubled back on the intermediate region 32 of the strap 22 and fixed thereto by, for example, stitching to form a second loop 52. The strap 22 is connectable to a second article, such as a boat bumper 54, by placing the strap 22 around the second article and feeding the first end region 28 through the second loop 52 and pulling on the first end region 28 so that the second loop 52 and intermediate region 32 snugly hold the second article. The second loop 52 constitutes means adjacent the second end region 30 for connecting the strap to the second article.

Figure 5:
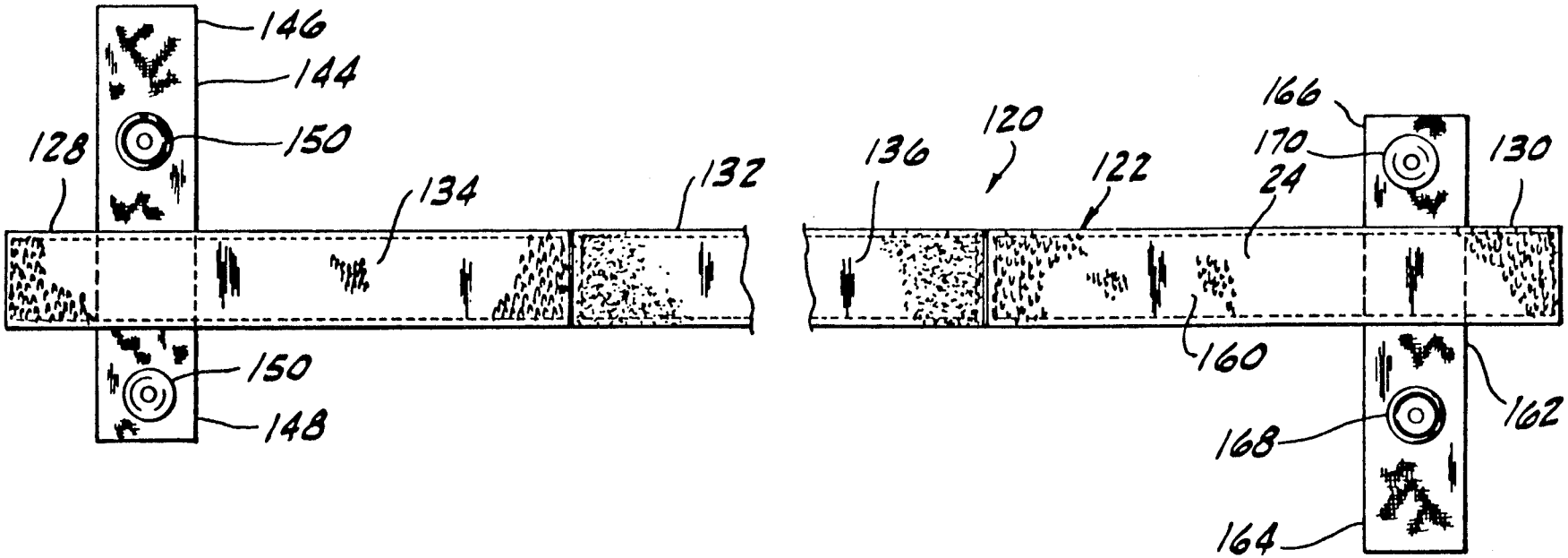
FIG. 5 is a second embodiment of a connector of this invention with similar fasteners on both ends of the connector.

Another embodiment of a connector constructed according to the principles of this invention is indicated generally at 120 in FIG. 5. The connector 120 is similar to the connector 20 of FIGS. 1–4, but connector 120 has similar snap-fastener-type mechanisms at both end regions. To simplify the description of this embodiment, corresponding parts are numbered the same as those parts shown in FIGS. 1–4 except the prefix "1" has been added to the reference numbers.

Like the connector 20, the connector 120 comprises a generally flat elongate flexible strap 122 having a first face 124, a second face, first and second end regions 128 and 130, and an intermediate region 132. A first panel of loop-type fastening material 134 is secured to the first face 124 of the strap 122 and adjacent the first end region 128 of the strap 122. A panel of hook-type fastening material 136 is secured to the first face 124 of the strap 122 and adjacent the intermediate region 132 of the strap 122. The panels 134 and 136 constitute mateable fastening means for forming a first loop around a first article. The first panel of loop-type fastening material 134 is selectively mateable with any one of several portions of the hook-type panel 136 along a predetermined range of the intermediate region 132 so that the size of the first loop 42 can be varied. A first strip 144 is transversely fixed to the strap 122 adjacent the first end region 128 of the strap 122. The first strip 144 includes a snap fastener 150 for securing a first end region 146 of the first strip 144 to a second end region 148 of the first strip 144. The first strip 144 and snap fastener 150 constitute means for securely locking the first loop-type panel 134 to any selected portion of the hook-type panel 136.

Rather than having a fixed second loop like the second loop 52 of the connector 20, the second end region 130 of the connector 120 is similar to the first end region 138. A second panel of loop-type fastening material 160 is secured to the first face 124 of the strap 122 and adjacent the second end region 130 of the strap 122. The second loop-type panel 160 is adapted for mating with the hook-type panel 134. The panels 134 and 160 constitute mateable fastening means for forming a second loop around a second article. The second loop-type panel 160 is selectively mateable with any one of several portions of the hook-type panel 136 along a predetermined range of the intermediate region 132 so that the size of the second loop can be varied.

A second strip 162 is transversely fixed to the strap 122 adjacent the second end region 130 of the strap 122. The second strip 162 has first and second end regions 164 and 166. A female portion 168 of a snap fastener is secured to the first end region 164 and a male portion 170 of the snap fastener is secured to the second end region 166 of the second strip 162. When the second loop-type panel 160 is mated with a portion of the hook-type panel 136, the second strip 162 is wrapped around the intermediate region 132 of the strap 122 and the female portion 168 of the snap fastener is snapped onto the male portion 170 of the snap fastener to maintain the second loop-type panel 160 in contact with the hook-type panel 136. Thus, the second strip 162 and snap fastener constitute means for securely locking the second loop-type panel 160 to any selected portion of the hook-type panel 136.

In operation, the connector 20 is adapted for securing a first article, such as a boat railing 38, to a second article, such as a boat bumper 54. The strap 22 is connected to the boat bumper by feeding the first end region 28 of the strap 22 through an aperture 56 of the bumper 54, then feeding the first end region 28 through the second loop 52, and then pulling on the first end region 28 so that the second loop 52 and intermediate region 32 snugly hold the bumper 54 as shown in FIG. 1. The strap 22 is placed around the railing 38 and the first end region 28 of the strap 22 is doubled back onto the intermediate region 32 to mate at least a portion of the loop-type panel 34 with a portion of the hook-type panel 36 and form the loop 42 around the railing 38. The strip 44 is wrapped around the intermediate region 32 of the strap 22 adjacent the selected portion of the hook-type panel 36 and the male and female portion **50*a* and 50*b* of the snap fastener 50 are fastened together to maintain the loop-type panel 34 in contact with the hook-type panel 36. The bumper 54, thus, is effectively tethered to the boat railing 38. The strip 44 prevents slippage of the connection between the panels 34 and 36 and, therefore, makes for a strong connection. To change the effective length of the connector 20, i.e., the length along the connector 20 between the boat railing 38 and the bumper 54, the snap fastener 50 is unfastened, the loop-type panel 34 is then pulled away from the hook-type panel 36, the loop-type panel 34 is then mated with a different portion of the hook-type panel 36, and the snap fastener 50 is fastened. Thus, adjustment of the connector 20** is quick and simple.

The connector 20 has been described as connecting a boat bumper to a boat railing. However, it is to be understood that any one of many different articles could be connected to any one of many other articles with the connector 20 without departing from the scope of this invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A connector for releasably securing a first article, such as a part of a boat, to a second article, such as a boat bumper, said connector comprising:

a generally flat elongate flexible strap having first and second faces, first and second end regions, and an intermediate region between the end regions;

first end connecting means adjacent the first end region for connecting the strap to the first article comprising first and second releasably mateable fastening means fixed to the first face of the strap for forming a first loop around the first article, the first fastening means being fixed to the first face of the strap adjacent the first end region and the second fastening means being fixed to the first face of the strap at the intermediate region, the first fastening means being selectively mateable with any one of several portions of the second fastening means along a predetermined range of the intermediate region so that the size of said loop can be varied, said first end connecting means further comprising means for securely locking the first fastening means to any selected portion of the second fastening means, the locking means being fixed to the strap adjacent the first end region of the strap so that the locking means is automatically positioned to secure the first fastening means to the selected portion of the second fastening means when said first loop is formed; and second end connecting means adjacent the second end region for connecting the strap to the second article.

2. The connector of claim 1 wherein the first and second fastening means comprise mateable panels of hook and loop type fastening material.

3. The connector of claim 1 wherein the locking means comprises:

a strip fixed transversely to the strap adjacent the first end region of the strap, said strip having first and second end regions;

means for securing a first end region of the strip to a second end region of the strip so that when the first and second fastening means are mated, the strip is wrapped around the intermediate region of the strap adjacent the selected portion of the second fastening means and the first and second end regions of the strip are secured together to maintain the first and second fastening means in contact with one another.

4. The connector of claim 3 wherein the means for securing the first end region of the strip to the second end region of the strip comprises a snap fastener.

5. The connector of claim 3 wherein the first and second fastening means comprise mateable panels of hook and loop type fastening material.

6. The connector of claim 1 wherein said second end connecting means adjacent the second end region comprises third and fourth releasably mateable fastening means fixed to the first face of the strap for forming a second loop for being placed around the second article, the third fastening means being fixed to the first face of the strap adjacent the second end region and the fourth fastening means being fixed to the first face of the strap at the intermediate region, the third fastening means being selectively mateable with any one of several portions of the fourth fastening means along a predetermined range of the intermediate region so that the size of said second loop can be varied, said second end connecting means further comprising means for securely locking the third fastening means to any selected portion of the fourth fastening means.

7. The connector of claim 6 wherein the means for locking the first fastening means to the second fastening means comprises:

a first strip fixed transversely to the strap adjacent the first end region of the strap, said first strip having first and second end regions;

means for securing a first end region of the first strip to a second end region of the first strip so that when the first and second fastening means are mated, the first strip is wrapped around the intermediate region of the strap adjacent the selected portion of the second fastening means and the first and second end regions of the first strip are secured together to maintain the first and second fastening means in contact with one another.

8. The connector of claim 7 wherein the means for locking the third fastening means to the fourth fastening means comprises:

a second strip fixed transversely to the strap adjacent the second end region of the strap, said second strip having first and second end regions;

means for securing a first end region of the second strip to a second end region of the second strip so that when the third and fourth fastening means are mated, the second strip is wrapped around the intermediate region of the strap adjacent the selected portion of the fourth fastening means and the first and second end regions of the second strip are secured together to maintain the third and fourth fastening means in contact with one another.

9. The connector of claim 8 wherein the fastening means are formed of mateable panels of hook and loop type fastening material, the second and fourth fastening means comprising an intermediate panel, the first fastening means comprising a first outer panel mateable with the intermediate panel, and the third fastening means comprising a second outer panel mateable with the intermediate panel.

10. The connector of claim 6 wherein the fastening means are formed of mateable panels of hook and loop type fastening material, the second and fourth fastening means comprising an intermediate panel, the first fastening means comprising a first outer panel mateable with the intermediate panel, and the third fastening means comprising a second outer panel mateable with the intermediate panel.

11. The connector of claim 6 wherein the means for locking the third fastening means to the fourth fastening means is fixed to the strap adjacent the second end region of the strap so that the locking means is automatically positioned to secure the third fastening means to the selected portion of the fourth fastening means when said second loop is formed.

12. The connector of claim 1 wherein said second end connecting means adjacent the second end region comprises a permanently fixed second loop, the second end region of the strap being doubled back on the intermediate region of the strap and permanently fixed thereto to form the second loop, the strap being connectable to the second article by placing the strap around the second article and feeding the first end region through the second loop and pulling on the first end region so that the second loop and intermediate region snugly hold the second article.

13. The connector of claim 12 wherein the means for locking the first fastening means to the second fastening means comprises:

a strip fixed transversely to the strap adjacent the first end region of the strap, said strip having first and second end regions;

means for securing a first end region of the strip to a second end region of the strip so that when the first and second fastening means are mated, the strip is wrapped around the intermediate region of the strap adjacent the selected portion of the second fastening means and the first and second end regions of the strip are secured together to maintain the first and second fastening means in contact with one another.

14. The connector of claim 13 wherein the means for securing the first end region of the strip to the second end region of the strip comprises a snap fastener.

15. The connector of claim 14 wherein the first and second fastening means comprise mateable panels of hook and loop type fastening material.

* * * * *